United States Patent [19]

Ackermann et al.

[11] 4,285,291

[45] Aug. 25, 1981

[54] NEEDLE GUARD FOR SEWING MACHINES

[75] Inventors: Manfred Ackermann, Elmhurst; Nicholas Alfano, Melrose Park, both of Ill.

[73] Assignee: Union Special Corporation, Chicago, Ill.

[21] Appl. No.: 68,040

[22] Filed: Aug. 20, 1979

Related U.S. Application Data

[63] Continuation of Ser. No. 914,693, Jun. 12, 1978, abandoned.

[51] Int. Cl.[3] ..... D05B 55/06; D05B 57/14; D05B 65/02

[52] U.S. Cl. ..... 112/184; 112/227; 112/292; 112/294; 112/297

[58] Field of Search ..... 112/181, 189, 227, 292, 112/294, 297, 184

[56] References Cited

U.S. PATENT DOCUMENTS

| | | | |
|---|---|---|---|
| 646,944 | 4/1900 | Baker | 112/189 |
| 1,484,191 | 2/1924 | Ringe | 112/227 X |
| 2,098,770 | 11/1937 | Zonis | 112/81 |
| 2,145,216 | 1/1939 | Vollman et al. | 112/112 |
| 2,161,140 | 6/1939 | DeVoe | 112/296 X |
| 2,218,556 | 10/1940 | Rubel | 112/181 X |
| 2,226,401 | 12/1940 | Haas | 112/292 |
| 2,310,320 | 2/1943 | Rubel | 112/227 |
| 2,688,293 | 9/1954 | Hayes et al. | 112/227 X |
| 2,694,373 | 11/1954 | Covert et al. | 112/181 |
| 2,883,953 | 4/1959 | Johnson | 112/227 X |
| 2,885,982 | 5/1959 | Hale | 112/184 X |
| 3,023,721 | 3/1962 | Johnson | 112/227 X |
| 3,044,427 | 7/1962 | Gardner et al. | 112/227 X |
| 3,120,204 | 2/1964 | Ketterer | 112/227 X |
| 3,125,049 | 3/1964 | Redman | 112/184 |
| 3,151,589 | 10/1964 | Kuhar | 112/227 X |
| 3,215,105 | 11/1965 | Kuhar | 112/227 X |
| 3,872,810 | 3/1975 | Johnson | 112/227 |
| 3,955,519 | 5/1976 | Weisz | 112/228 |
| 4,077,342 | 3/1978 | Steckenrider | 112/297 |

*Primary Examiner*—Wm. Carter Reynolds
*Attorney, Agent, or Firm*—John W. Harbst; John A. Schaerli

[57] ABSTRACT

This invention relates to a needle guard which is adapted to position the needle relative the lower stitch forming mechanism and further serves to minimize skipped stitches during the sewing operation. The needle guard is positioned beneath the work supporting surface of the machine and during the sewing operation is disposed proximate the needle path. Upon completion of the sewing operation the needle guard is retracted from the path of the needle. Adjustable means are provided so as to accomodate the needle guard to needles of various sizes and to permit positioning of the needle guiding surface with respect to the path of the needle.

11 Claims, 7 Drawing Figures

NEEDLE GUARD FOR SEWING MACHINES

This is a continuation of application Ser. No. 914,693 filed June 12, 1978, now abandoned.

BACKGROUND OF THE INVENTION

This invention relates to sewing machines and more particularly to an improved needle guard for sewing machines.

The present invention is a further development of the machine forming the subject matter of U.S. Pat. No. 4,077,342 granted Mar. 7, 1978 to P. E. Steckenrider. In such machines a rotary loop taker is disposed beneath a flat work supporting plate which is provided with an aperture to receive a substantially vertically disposed needle adapted for reciprocation through such aperture for the purpose of cooperating with the loop taker in the formation of stitches. In descending, the needle passes in close proximity to the path of the beak of the rotating loop taker and on its upstroke the needle throws out a thread loop which is entered by the beak after which the beak carries the needle thread loop about the lower stitch forming mechanism. In the event that the needle is bent or deflected by heavy weight materials, a cross seam or any irregularity in the material being sewn, it may, during its descent, strike the rotary loop taker with the result that the hook may be scored or otherwise damaged, or the needle may be broken.

In addition, the taper of many types of needles used in sewing machines has different configurations depending upon the material being stitched. The presence of the different tapers and different diameter needles makes it very desirable to provide a needle guard having the capabilities whereby it can be accurately adjusted to function with the particular needle chosen for the material to be stitched.

So as to overcome the above mentioned problems it has been heretofore proposed to provide a needle guard which is fastened for rotation and operable with the rotary hook. It is known to provide the hook with a deflecting surface so as to assure positioning of the needle relative the loop seizing beak. However, by positioning a needle guard on only one side of the needle it may not be possible to prevent skewing of the needle in a direction away from the loop seizing beak. When the needle skews away from the loop seizing beak there remains the possibility of needle breakage and hook damage and in addition there is a greater chance of skipped stitches resulting in poor seams and inacceptable garments. Further, some of the heretofore known needle guards are actuated in timed relationship with needle reciprocation whereby requiring additional mechanisms and thus added costs to the price of the machine.

As particularly applicable to the present invention, the problem of providing a needle guard for a machine of the type described in the above identified patent is further enhanced by the thread cutting mechanism which is employed thereon. The problem is enhanced because the path of movement of the thread cutting mechanism requires that at least one of the cutting blades traverse the plane defined by the needle's path. In this regard, it is necessary not only for the present invention to be able to prevent needle skewing but also requires that the needle guard be removed from the area proximate the needle's path upon completion of the sewing operation so as to allow subsequent trimming operations to be executed. In accordance with the present invention needle skewing is substantially eliminated and a device is provided which can be retracted from the sewing area so as not to interfere with subsequent trimming operations. Further, the present invention is relatively easily adjustable in a manner which allows adjustment of the needle guard relative the path of the needle as will be apparent hereinafter. An additional advantage of the present invention is that, because of its presence in the proximity of the needle during sewing, it acts to prevent formation of an appreciable thread loop opposite the looptaker so as to minimize skipped stitches.

GENERAL DESCRIPTION OF THE INVENTION

The present invention relates to needle guards for positioning the needle relative the lower stitch forming mechanism and further serves to minimize skipped stitches. In general, the needle guard of the present invention comprises an arm or ternary member one end of which is pivotally anchored to a supporting element. The arm is further provided with a needle positioning surface which, during sewing, may remain proximate the path of the needle. Thus, when the needle rises from its maximum penetration, the present invention will serve to assure that the needle thread loop will be formed on the loop seizing side of the needle. Upon completion of the sewing operation the needle guard is retracted from the sewing area by a suitable part of the sewing machine which moves to a predetermined position upon completion of the sewing operation. An adjustable means, which includes an eccentric member, pivotally secures or anchors the needle guard in a manner such that the location of the needle positioning surface may be changed to account for changes in needle sizes.

Accordingly, it is a primary object of this invention to provide a novel and improved needle guard for sewing machines.

It is another object of this invention to provide a needle guard which is simple in operation but yet economical and effective.

It is yet another object of this invention to provide an improved means for positioning the needle of a rotary hook sewing machine.

Another object of this invention is the provision of suitable means for minimizing skipped stitches.

Yet another object of this invention is the provision of a needle guard which is adjustable relative the needle path thereby accommodating needles of various sizes.

Having in mind the above and other objects that will be evident from an understanding of this disclosure, the invention comprises the devices, combinations and arrangement of parts as illustrated in the presently preferred embodiment of the invention which is hereinafter set forth in such detail so as to enable those skilled in the art to readily understand the function, operation, construction and advantages of it when read in conjunction with the accompanying drawings in which.

DETAILED DESCRIPTION OF THE INVENTION

Figure 1:
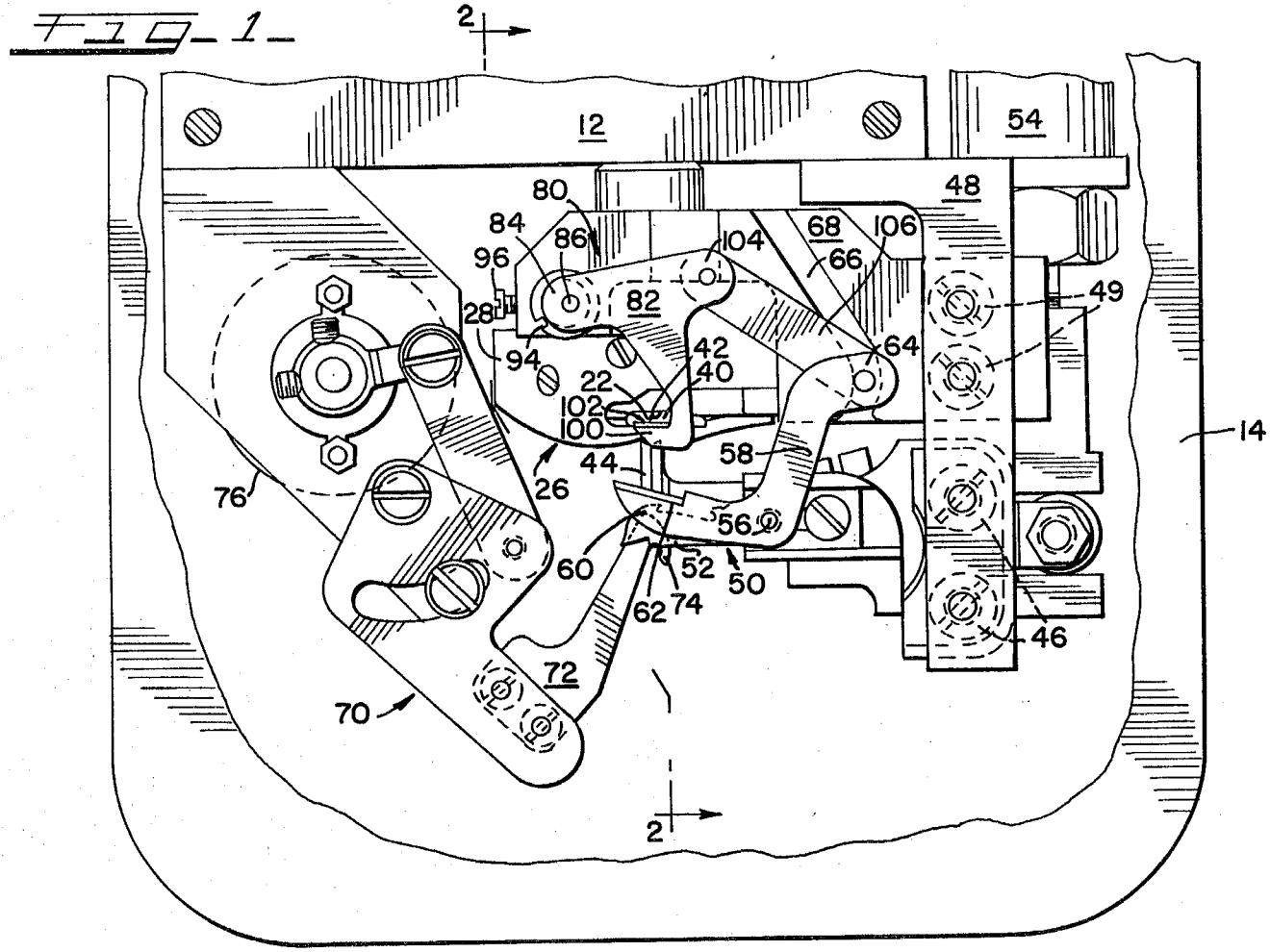
FIG. 1 is a fragmentated top plan view illustrating the present invention and showing the thread cutter in its retracted position.
Figure 5:
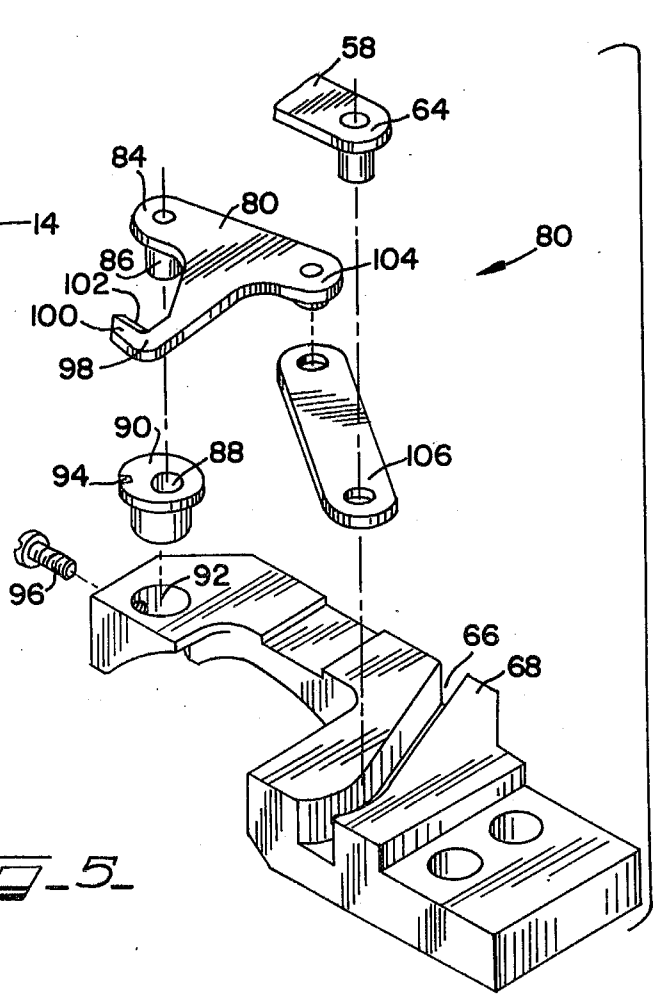
FIG. 5 is an exploded perspective view showing the various elements of the present invention.
Figure 2:
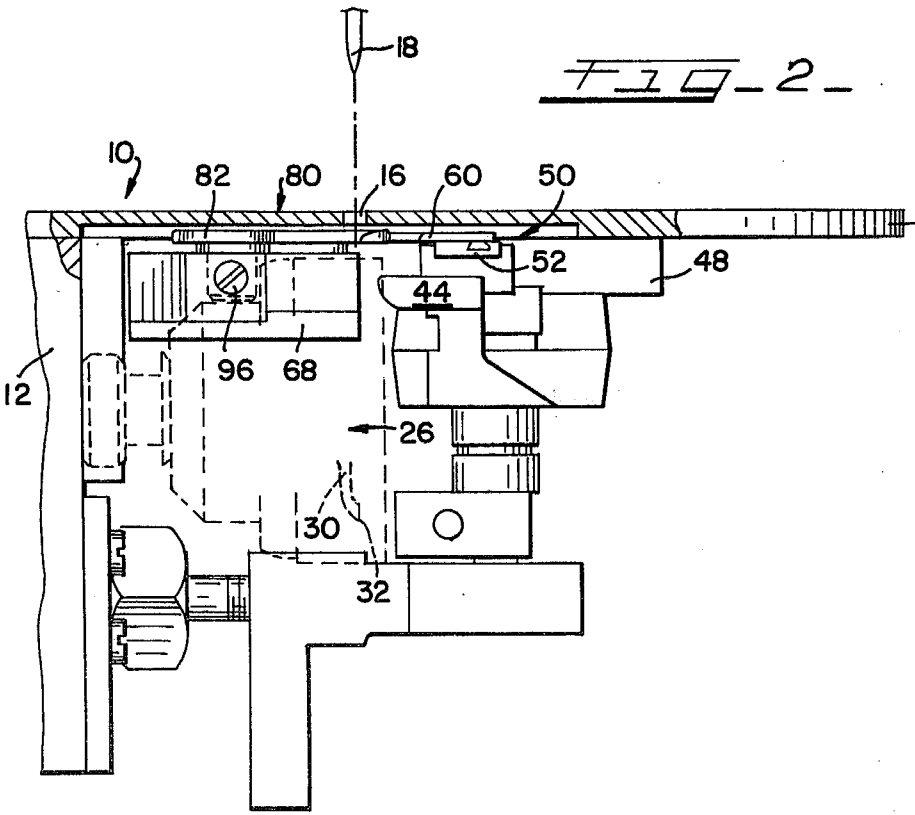
FIG. 2 is a sectional view taken along line 2—2 of FIG. 1.

With reference to the drawings, the invention has been shown as embodied in an automatic sewing machine 10 which may be of the type described in the above identified U.S. Patent. The machine 10 has a bed or frame 12 to which is secured a throat plate 14 the upper surface of which constitutes a part of the work supporting surface. The throat plate 14 has a needle aperture 16 through which a substantially vertically reciprocating needle 18 carrying an upper or needle thread 20 moves and defines a point of stitch formation 22. During the sewing cycle, the needle 18 and needle thread cooperate in the formation of stitches with a lower thread 24 which is manipulated by a lower stitch forming mechanism, indicated generally at 26.

For purposes of this description suffice it to say that a sewing cycle is defined as that length of time that the machine is sewing on any given operation. In the present embodiment, the mechanism 26 includes, among other well known elements, a rotary hook 28 formed with a loop seizing beak 30 that terminates in a loop seizing point 32. The reciprocation of the needle 18 defines a needle path relative the hook 28 and the hook is arranged on one side of and closely adjacent to the generally vertical plane defined by the needle's straight line path of travel with the loop seizing point 32 passing in loop seizing relation to the needle thread 20. The mechanism 26 which carries the lower thread is similar to the lower stitch forming mechanism shown in U.S. Pat. No. 2,694,373 granted Nov. 16, 1954 to John N. Covert et al, which is incorporated herein by reference and thus need not be described in complete detail. Suffice it to say that within the rotary hook 28 is journalled a bobbin case holder 34, which is held in the hook by a gib 36 secured by screws 38 to the periphery of the hook. The bobbin case holder 34 is provided with a needle opening 40 adapted to permit entrance of the needle 18 into the rotary hook so that a needle loop may be formed upon the initial upward movement of the needle. The rearward surface 42 of the opening 40 is beveled and acts as a needle positioning surface on one side of the needle 18. The bobbin case holder 34 is held against rotation with the hook 28 by a rotation restraining finger means 44. The latter being secured by screws 46 to the underside of a thread cutter support means 48.

Also located on the underside of the throat plate 14 is a thread cutter assembly means 50 having a pair of cooperating blades adapted to move in a generally horizontal plane. The thread cutter includes a blade means 52 which is adapted to be driven by a suitable actuator means, such as a pneumatic cylinder, indicated at 54. Pivotally connected at 56 with the blade means 52 is an arm or member means 58, one end 60 of which forms a second blade means 62. The other end 64 of member 58 is operatively associated with a camming slot 66 formed in a supporting element 68 which is secured to the thread cutter support means 48 by any suitable means such as screws 49. It should be pointed out that upon completion of the sewing operation the arm means 58 is moved in a predetermined manner under the influence of the camming slot 66 to the position shown in FIGS. 3 and 4.

So as to assure that a sufficient thread starting tail length is provided at the onset of subsequent stitching operations, the machine 10 is further provided with a thread catching means 70. The thread catching means 70 includes a member or arm 72 having a thread catching hook 74. The arm 72 is actuated and moved to a predetermined position upon completion of the sewing operation, through a suitable mechanism, such as an electric solenoid means, generally indicated at 76. The arm 72 is moved in such a manner upon completion of the sewing operation that the hook 74 is in a position to pull a sufficient length of thread so as to assure the correct formation of subsequent stitches. For a more detailed description of both the thread cutter assembly means 50 and the thread catching means 70 reference should be made to the above identified Steckenrider patent.

As was mentioned above and as can happen when sewing heavy weight materials (leather, canvas, etc.), running into irregularities in the material or various other conditions, the path of the sewing machine needle may skew or be deflected from its normal path. In some instances the needle may skew to such a degree that its path may interfere with the bobbin case holder. If this occurs, the needle skewing may cause damage to the lower stitch forming mechanism, or the needle or possibly both. By correctly positioning the needle guiding surface 42 it may be possible to prevent the needle from skewing in the direction toward the hook 28. So as to prevent the needle from skewing in a direction away from the hook 28 the present invention provides a needle guard on the other side of the needle. The needle guard of the present invention is positioned proximate the generally vertical path or plane scribed by the linear reciprocation of the needle during the sewing operation so as to position same relative the loop seizing point of the rotary hook and upon completion of the sewing operation is retracted so as to allow subsequent trimming operations to occur. That is, the needle guard is maintained generally stationary during the sewing cycle but is movable, for the first time, at the completion of the sewing cycle to a position removed from the needle's path. For purposes of this description, suffice it to say that the sewing cycle is complete when the needle exits the work on its final reciprocatory movement.

According to the presently preferred embodiment, and as may be best seen in FIGS. 1 through 5, the needle guard assembly 80 of the present invention includes an arm of ternary member 82, which is pivotally anchored in the supporting element 68. As should be apparent from FIG. 2, the support element 68 is adapted to mount the needle guard 80 coplanar with the path of travel of the thread cutting assembly means 50. One leg 84 of element 82 is provided with a depending retaining element 86 which is received and guided within an aperture 88 formed within a cylindrically shaped plug member 90. It should be mentioned that the aperture 88 is eccentric from the axis of the plug itself for reasons discussed hereinafter. The plug 90 is supported for rotation in an aperture or bore 92 formed in the supporting element 68. A depression 94 is formed in the edge of a flange portion on the top of the plug 90. The depression may be in the form of a slot adapted for receiving a tool so that the plug may be rotated within the bore 92. Threadably secured in the support element 68 is a screw 96. Screw 96 is adapted to secure the plug 90 against rotation once the latter, and more particularly, once the eccentricity of the aperture 88 is set to the correct position, as will be described hereinafter. The free end 98 of arm 82 is provided with a short extension 100 having a needle positioning surface 102. The needle positioning surface 102 is situated on one side of the vertical plane defined by the needle's straight line reciprocatory path and opposite to the loop taker's needle guiding surface 42 located on the opposite side of said vertical plane. In this manner, the needle is generally constrained from skewing in a direction both away from or toward the loop seizing point 32 by the positioning surface 102 and the guiding surface 42, respectively. Leg 104 of member 82 is operatively connected to lever means 58 by means of a pivotal link 106. Accordingly, upon completion of the sewing operation, when the thread cutting assembly 50 is actuated, the arm means 58 forcibly moves the member 82 in unison therewith. The arm 82 is pivoted about the axis of pin means 86 whereby automatically retracting the needle position surface 102 from the area proximate the plane of the needle.

Figure 6:
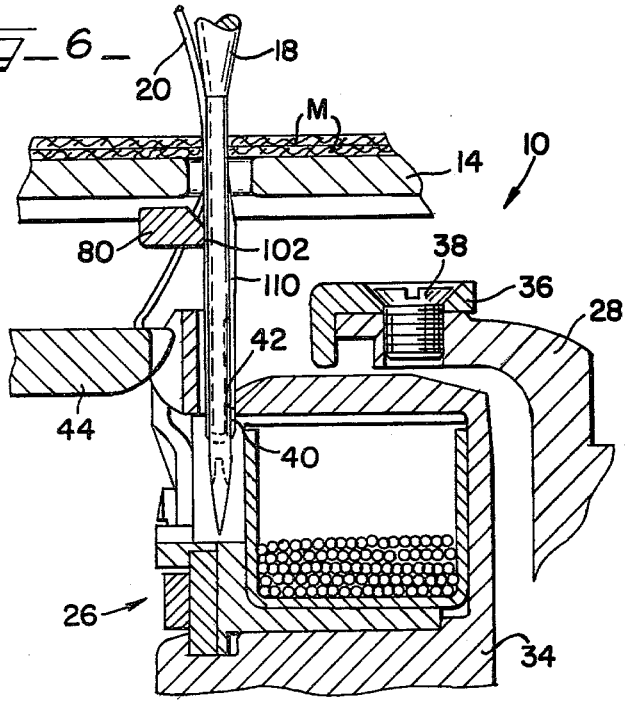
FIG. 6 is an enlarged sectional view illustrating the invention in its operative position and showing the needle in its lower most position.
Figure 7:
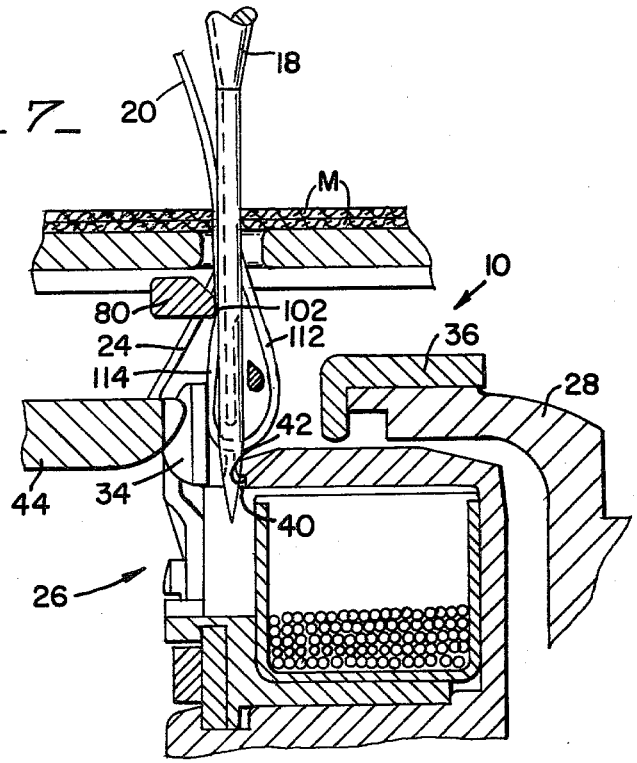
FIG. 7 is a view similar to FIG. 6 but showing the needle after it has risen from its lowermost position.

Turning to FIGS. 6 and 7, a further advantage of the present invention is that the needle guard 80 is adapted to assist in controlling the thread loop cast by the needle. When the sewing machine 10 is in operation and the needle 18 is in its lowermost position (FIG. 6) the work limb 110 of the thread 20 is on the loop seizing side of the needle. As the needle rises from its lowermost position shown in FIG. 6 to the position shown in FIG. 7, the friction between the needle thread and the workpieces M being sewn causes the needle thread to form a loop 112 (FIG. 7) on the loop seizing side of the needle. Formation of the needle loop 112 tends to feed the needle thread 20 backward through the eye of the needle and thus tends to form a small loop 114 on the side opposite the loop 112 thus causing the loop 112 to be smaller than it should be. In order to assure that the beak 30 will enter a fully formed loop 112 on the loop seizing side of the needle, the present invention is positioned such that the positioning surface 102 on the needle guard acts as a pincher by engaging the needle thread on the side opposite the needle loop 112. Thus when the needle rises from the position shown in FIG. 6 to the position in FIG. 7 the proximity of the positioning surface 102 with respect to the needle thread may prevent the thread from "ballooning" out opposite the loop seizing side of the needle, thereby assuring that a proper sized needle thread loop 112 will be formed on the loop seizing side of the needle.

Figure 3:
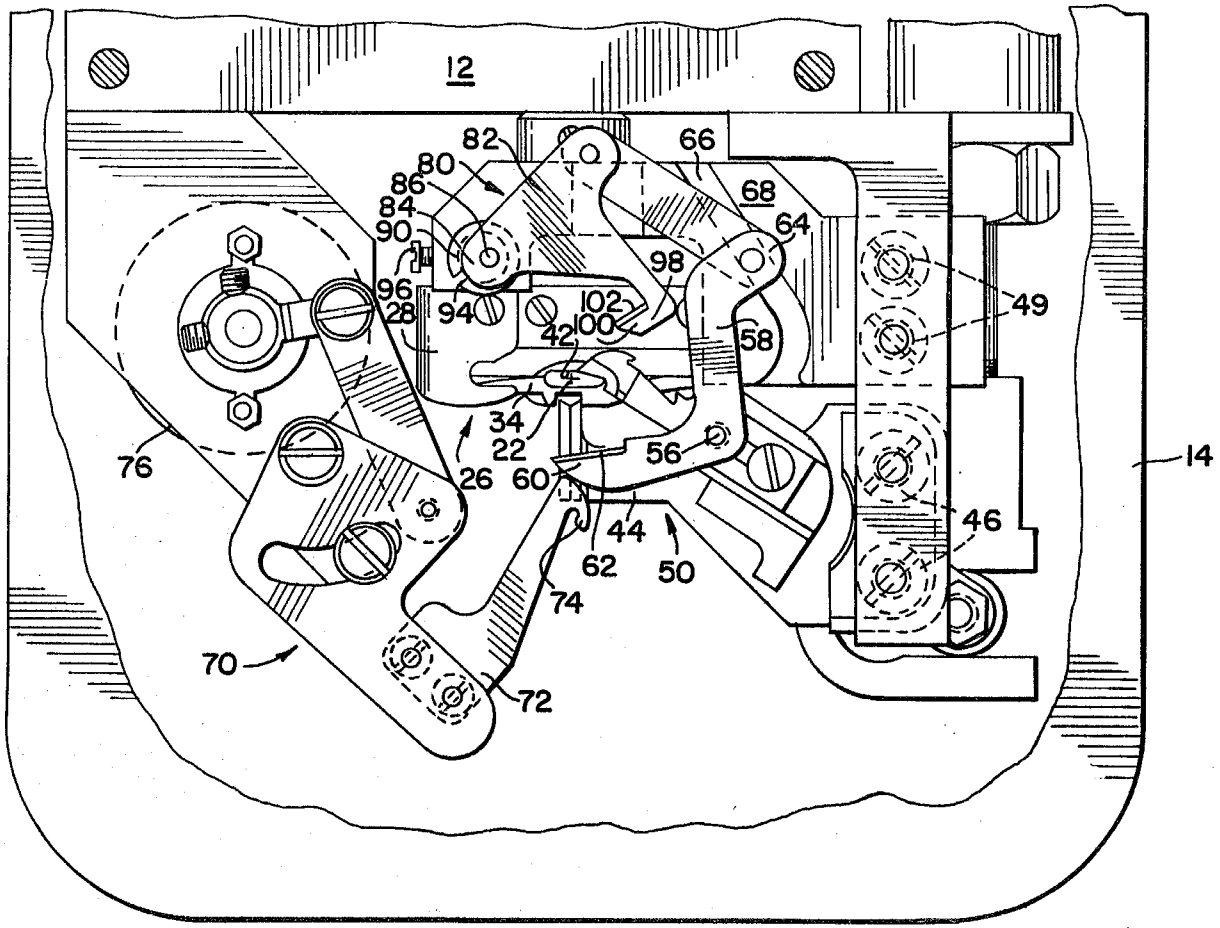
FIG. 3 is a fragmentated top plan view similar to FIG. 1 and illustrating the needle guard in its retracted position.
Figure 4:
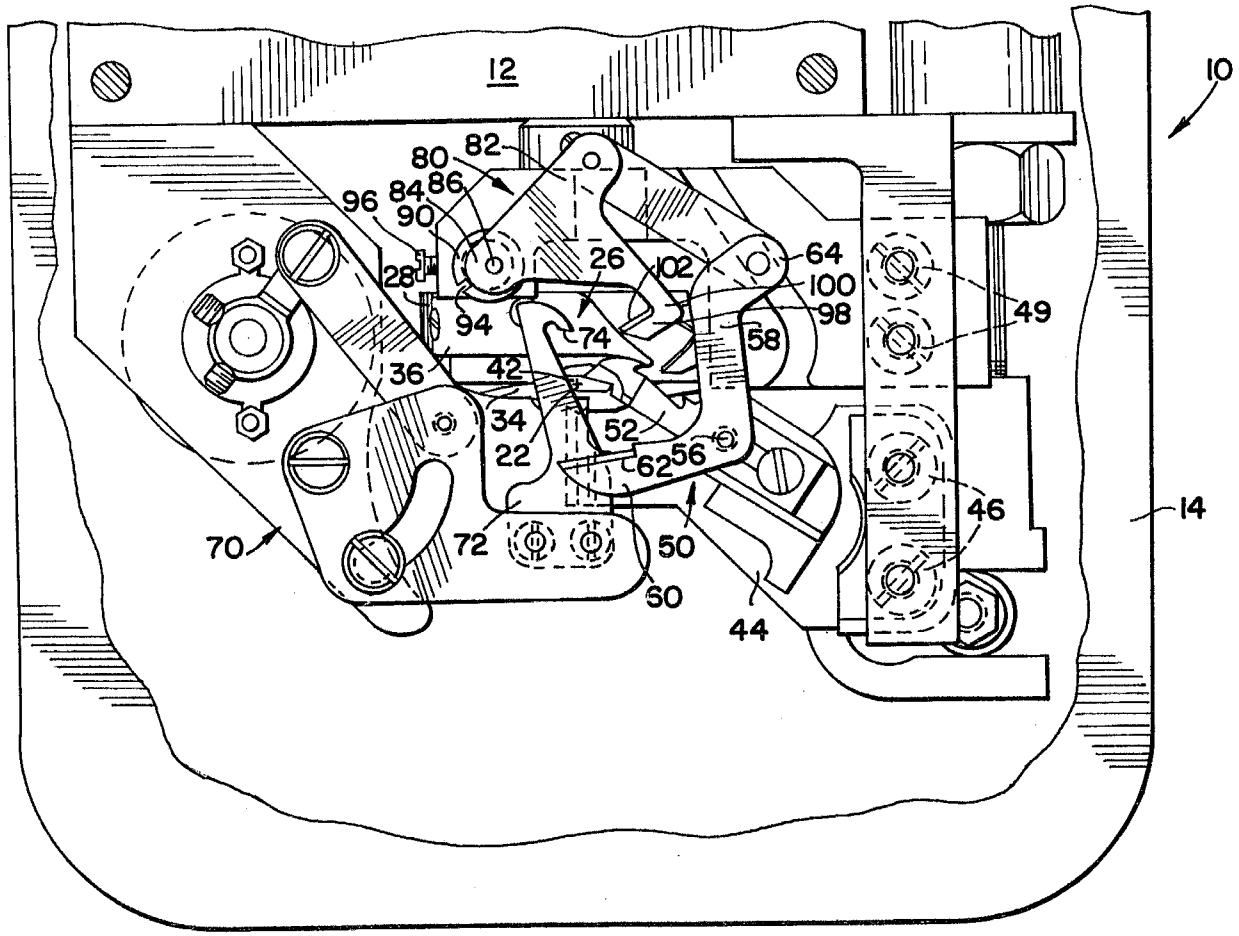
FIG. 4 is a fragmentated top plan view illustrating the invention and showing the bobbin thread pull off in its forward position.

Persons versed in the sewing machine art will understand that while the sewing machine 10 is performing a stitching operation, the thread cutting assembly means 50 and thread catching means 70 are held in the position shown in FIG. 1. While in this position the needle positioning surface 102 is in a position to engage the needle so as to position same relative the loop seizing point 32. As was mentioned above, upon completion of the sewing operation, the needle guard assembly 80 is adapted to be automatically retracted by a part of the sewing machine when the latter comes to an end of the stitching operation. In the present instance, the needle guard assembly 80 is operably driven by and in unison with the lever means 58 when the latter is moved into its predetermined position shown in FIG. 3. As shown in FIG. 3, once the arm 58 is moved in a predetermined manner the needle guard is removed from interfering with the thread trimming mechanism. During the time the thread cutting mechanism is moved to the position shown in FIG. 3, the arm means 72 is actuated and moved into the position shown in FIG. 4. The arm 72 is moved to a position where the hook 74 grasps the thread and pulls same so as to provide a sufficient length of thread after the cutting operation whereby assuring the correct formation of subsequent stitches.

As was also mentioned above and so as to accomodate various needle sizes, the present invention provides means for adjusting the needle guard toward or away from the plane defined by the path of the needle. When making the adjustment, the screw 96 is sufficiently loosened so as to allow the plug member 90 to be turned. By turning the plug member the eccentricity of the aperture 88 causes one end of the needle guard to be adjusted in such a manner that the needle position surface 102 is moved toward or away from the plane of the needle. When the adjustment is satisfactorily made, the screw is tightened to secure the plug 90 and thus secure the adjustment of the needle guard and more particularly the needle positioning surface 102.

As is apparent the needle guard of the present invention is simple and easy to adjust. While the present invention provides a needle positioning surface to position the needle and act as an aid in forming the needle loop during sewing it is further adapted for retraction from the plane of the needle upon completion of the sewing cycle so as to allow subsequent operations to occur.

Numerous alterations to the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention are intended to be included within the scope of the appended claims.

What is claimed:

1. In combination with a sewing machine having a reciprocating needle adapted to carry a needle thread, a rotary hook having a loop seizing member, a thread cutting mechanism having an arm adapted to be moved into a predetermined position upon completion of the sewing operation, and a needle guard assembly comprising:

a support member;

a ternary member rotatably supported by said support member, said ternary member having a needle positioning surface disposed adjacent the path of travel of said needle and providing a working clearance with said needle thread whereby said surface acts as a pinching finger thereby preventing said needle thread from forming a loop on the side of the needle opposite the loop seizing member; and means operative through the actuation of said arm to force said ternary member into a retracted position whereby removing said positioning surface from adjacent the path of the needle.

2. A sewing machine having in combination a thread carrying needle adapted for movement in an endwise reciprocatory path during a sewing cycle, a lower stitch forming mechanism arranged to manipulate a lower thread and to cooperate with said needle in the formation of stitches, a member movable to a predetermined position upon completion of the sewing cycle, and a needle guard comprising:

first operative means adapted to engage said needle and to position same relative to said lower stitch forming mechanism; and second operative means for synchroneously moving said member and said first operative means and effective to maintain said first operative means in a generally stationary position relative to the needle's path during the sewing cycle but then impart initial movement to and remove same from its stationary position upon completion of the sewing cycle.

3. A sewing machine having in combination a needle adapted for reciprocation during a sewing cycle, a member movable to an operative position upon completion of the sewing cycle and a needle guard comprising:

an arm means having a needle positioning surface thereon, said arm means being mounted for movement between a first position whereat said needle positioning surface is adjacent the path of movement of said needle and a second position removed from the path of said needle; and means for maintaining said arm means generally stationary in said first position during the reciprocation of said needle and then move said arm means upon completion of the sewing cycle to said second position, said member being simultaneously moved therewith.

4. The invention as defined in claim 3 and including means permitting adjustment of said needle positioning surface in a direction toward or away from the path of the needle.

5. In combination with a sewing machine having a reciprocatory thread carrying needle, work support means disposed generally in a horizontal plane, a loop taker arranged for cooperation with said needle in the formation of stitches, a trimming device including a cutting element displaceable along a path substantially parallel to said work support means and in a predetermined manner upon completion of a sewing operation and a needle guard comprising:

arm means including a needle positioning surface arranged adjacent to a plane defined by the path of the needle for positioning said needle in relation to said loop taker;

a supporting element for turnably supporting said arm means in a plane substantially coplanar with a plane defined by the displacement path of said cutting element; and means for operating said trimming device and said arm means in concert so as to initially remove said needle positioning surface from its location adjacent the needle's path upon completion of the sewing operation.

6. The invention as recited in claim 5 and further comprising an adjustable anchoring plug means supported by said supporting element and adapted to receive and support one leg of said arm means.

7. The invention as recited in claim 6 wherein said plug means is adjustable for changing the position of said positioning surface relative a plane defined by the path of the needle.

8. In combination with a sewing machine having a thread carrying needle arranged for movement in an endwise reciprocatory path, a loop taker arranged for cooperation with said needle in the formation of stitches, a trimming device including a cutting element displaceable in a predetermined manner upon completion of a sewing operation and a needle guard comprising:

arm means including a depending retaining element and a surface arranged adjacent to a plane defined by the needle's path for positioning said needle in relation to said loop taker;

a supporting element for turnably supporting said arm means;

an adjustable anchoring plug means supported by said supporting element, said anchoring plug means is provided with an aperture for receiving said retaining element, said aperture being in an off-set relationship with respect to the axis of said plug means such that upon rotation of said plug means the location of said positioning surface relative to the plane of the needle will be affected; and means for operating said trimming device and said arm means in concert so as to initially remove said surface from its location adjacent the needle's path upon completion of the sewing operation.

9. A sewing machine having in combination a stitch forming mechanism including a needle adapted for reciprocation during a sewing cycle, a member shiftable to a predetermined position upon completion of the sewing operation cycle and a needle guard assembly comprising:

movably mounted element means having a needle engaging surface disposed thereon;

means for sequentially positioning said element means such that the needle engaging surface is in a generally stationary operative position during the sewing operation cycle and is subsequently moved for the first time to a non-operative position at the completion of the sewing operation cycle;

means operatively connecting said member and said element such that they are moved in unison.

10. A sewing machine having in combination a thread carrying needle adapted for reciprocatory motion during a sewing cycle, a lower stitch forming instrumentality having a loop seizing point adapted to cooperate with said needle in the formation of stitches, a needle deflecting surface formed as part of said lower stitch forming instrumentality and arranged on one side of the needle, member means displaceable between first and second positions following completion of a sewing cycle and a needle guard comprising:

means operative disposed on the other side of said needle in a position proximate the needle's path for engaging and positioning said needle relative said loop seizing point; and said means operative being responsive to the displacement of said member means and adapted to remain generally stationary proximate the needle's path during the sewing cycle and being initially moved from a position proximate the needle's path upon completion of the sewing cycle and concurrently with displacement of said member means to its second position.

11. A sewing machine having in combination a thread carrying needle adapted for movement in an endwise reciprocatory path during a sewing cycle, a lower stitch forming mechanism arranged to manipulate a lower thread and to cooperate with said needle in the formation of stitches, and a needle guard means comprising:

means operative for engaging and positioning said needle relative to said lower stitch forming mechanism, said means operative being adapted to remain in a generally stationary position relative to the needle's path during the sewing cycle but then initially and automatically move from its stationary position at the completion of the sewing cycle.

* * * * *